US009856106B1

(12) United States Patent
Stewart et al.

(10) Patent No.: US 9,856,106 B1
(45) Date of Patent: Jan. 2, 2018

(54) DYNAMIC FEEDING SYSTEMS FOR KNITTING MACHINES

(71) Applicant: The Boeing Company, Chicago, IL (US)

(72) Inventors: Tiffany A Stewart, Sherman Oaks, CA (US); Guillermo Herrera, Winnetka, CA (US); Jacob John Mikulsky, Santa Monica, CA (US); Christopher P Henry, Thousand Oaks, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/196,562

(22) Filed: Jun. 29, 2016

(51) Int. Cl.
*B65H 59/38* (2006.01)
*B65H 59/04* (2006.01)
*D04B 15/44* (2006.01)

(52) U.S. Cl.
CPC ..... *B65H 59/387* (2013.01); *B65H 59/04* (2013.01); *D04B 15/44* (2013.01)

(58) Field of Classification Search
CPC ..... B65H 59/04; B65H 59/387; D04B 15/44
See application file for complete search history.

(56) References Cited

U.S. PATENT DOCUMENTS 3,571,680 A 3/1971 Handelsman et al.
3,967,471 A * 7/1976 Matsumoto ..... D04B 15/44 57/80
4,530,471 A * 7/1985 Inoue ..... B23H 7/10 219/69.12
5,423,197 A * 6/1995 Roser ..... B65H 51/30 242/365.7
2010/0090051 A1* 4/2010 Groff ..... B65H 23/042 242/414.1

FOREIGN PATENT DOCUMENTS

DE 3923261 A1 * 1/1991 ..... B23H 7/10
EP 0061975 A1 * 10/1982 ..... B65H 59/387
EP 2868609 A1 * 5/2015 ..... B65H 59/36
FR 2545464 A1 * 11/1984 ..... B65H 59/387
WO 2013045982 A1 4/2013
WO 2013064879 A1 5/2013
(Continued)

OTHER PUBLICATIONS

Machine Translation of Fr 2 545 464 A1, Nov. 9, 1984.*
(Continued)

*Primary Examiner* — William E Dondero
(74) *Attorney, Agent, or Firm* — Duft Bornsen & Fettig LLP

(57) ABSTRACT

Systems and methods are provided for feeding thread at a knitting machine. One embodiment is a thread feeding device which includes a spool that supplies thread to a knitting device through a thread path and a motor that drives the spool. The device and further includes a mobile guide in the thread path that changes position due to changes in thread tension as the knitting device draws thread through the mobile guide. The thread feeding device also includes a sensor that measures a change in position of the mobile guide, and a controller that determines an amount of tension applied to the thread by the knitting device based on the change in position, and adjusts a speed of a motor that drives the spool based on the amount of tension.

26 Claims, 7 Drawing Sheets

(56) References Cited

FOREIGN PATENT DOCUMENTS

| | | | | | |
|---|---|---|---|---|---|
| WO | 2013088221 | A1 | | 6/2013 | |
| WO | 2014097027 | A1 | | 6/2014 | |
| WO | WO-2016198755 | A1 | * | 12/2016 | ..... B29C 70/382 |

OTHER PUBLICATIONS http://www.knittingindustry.com article: Stoll's ADF technology: A new dimension in flat knitting? May 9, 2016.
http://www.stoll.com/stoll-produkte/cms-530-hp-en article; Reutlingen, Deutschland; May 9, 2016.

* cited by examiner

DYNAMIC FEEDING SYSTEMS FOR KNITTING MACHINES

FIELD

The disclosure relates to the field of automated knitting, and in particular, to feeding material to a knitting machine.

BACKGROUND

Knitting is performed in order to create complex textiles and fabrics. In order to save labor costs when knitting particularly complex fabrics (e.g., those that include metal wires or other non-standard threads), it is common to utilize an automated knitting machine. An automated knitting machine may be used, for example, to knit complex patterns into a unified fabric based on input from a controller.

While automated knitting machines operate, they draw thread from one or more spools. The speeds at which threads are drawn may vary depending on the type of design being knitted, as well as whether the knitting machine is knitting in a "forward" or "backwards" direction. The speeds may also vary over time as the knitting machine uses more or less of a given thread.

Knitting machines remain desirable for a number of uses, but their utility when knitting fabrics that include exotic threads/filaments is limited. Certain threads may snap if they experience more than even a few centiNewtons (cN) of tension, which is undesirable because a broken thread results in substantial time delays as re-threading takes place. Furthermore, the programs utilized by knitting machines do not take into account the types of threads being actively knitted. Hence, apart from directing a knitting machine to operate very slowly (which is not economical), these problems with utilizing exotic threads are unavoidable.

SUMMARY

Embodiments described herein present enhanced feeding mechanisms for automated knitting machines. These feeding mechanisms dynamically respond to the changing and unpredictable feeding speeds of a knitting device of a knitting machine, ensuring that tension applied to a thread being fed to a knitting device does not exceed a threshold level.

One embodiment is a thread feeding device which includes a spool that supplies thread to a knitting device through a thread path and a motor that drives the spool. The device and further includes a mobile guide in the thread path that changes position due to changes in thread tension as the knitting device draws thread through the mobile guide. The thread feeding device also includes a sensor that measures a change in position of the mobile guide, and a controller that determines an amount of tension applied to the thread by the knitting device based on the change in position, and adjusts a speed of a motor that drives the spool based on the amount of tension.

Another embodiment is a method. The method includes measuring thread tension as the thread is fed into a knitting device, and controlling a speed at which the thread is fed into the knitting device based upon the measured thread tension.

Another embodiment is a non-transitory computer readable medium embodying programmed instructions which, when executed by a processor, are operable for performing a method. The method includes measuring thread tension as the thread is fed into a knitting device, and controlling a speed at which the thread is fed into the knitting device based upon the measured thread tension.

Other exemplary embodiments (e.g., methods and computer-readable media relating to the foregoing embodiments) may be described below. The features, functions, and advantages that have been discussed can be achieved independently in various embodiments or may be combined in yet other embodiments further details of which can be seen with reference to the following description and drawings.

DESCRIPTION OF THE DRAWINGS

Some embodiments of the present disclosure are now described, by way of example only, and with reference to the accompanying drawings. The same reference number represents the same element or the same type of element on all drawings.

DESCRIPTION

The figures and the following description illustrate specific exemplary embodiments of the disclosure. It will thus be appreciated that those skilled in the art will be able to devise various arrangements that, although not explicitly described or shown herein, embody the principles of the disclosure and are included within the scope of the disclosure. Furthermore, any examples described herein are intended to aid in understanding the principles of the disclosure, and are to be construed as being without limitation to such specifically recited examples and conditions. As a result, the disclosure is not limited to the specific embodiments or examples described below, but by the claims and their equivalents.

Figure 1:
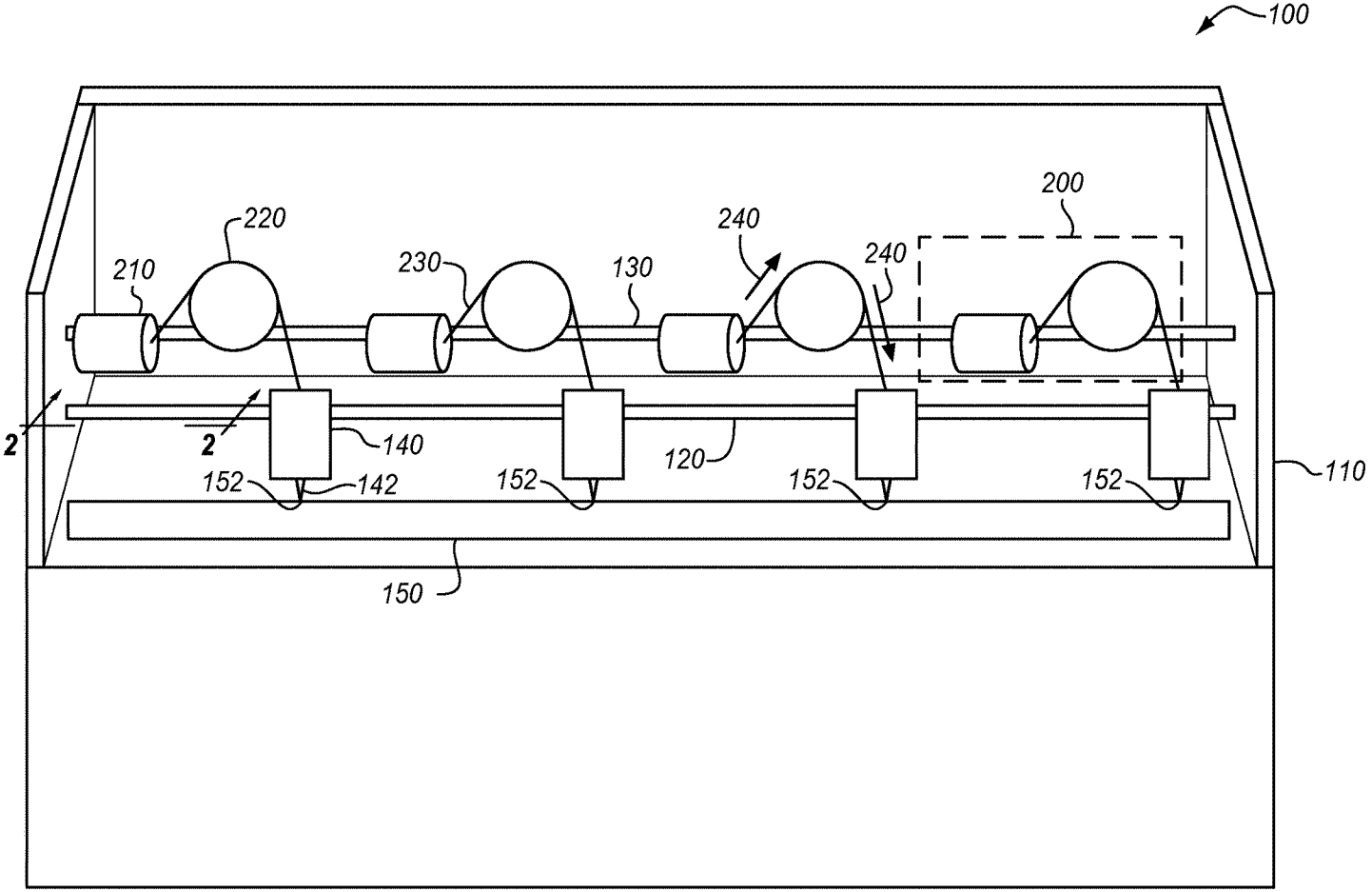
FIG. 1 is a diagram of knitting machine in an exemplary embodiment.

FIG. 1 is a diagram of knitting machine 100 in an exemplary embodiment. Knitting machine 100 draws in thread from thread feeding devices 200, which each comprise a spool 210 coupled with a thread path 220. In this embodiment, knitting machine 100 includes frame 110, to which supports 120 and 130 are attached. Knitting machine 100 further includes knitting devices 140, which each utilize one or more needles 142 to weave and/or stitch fabric 150 at locations 152. Knitting machine 100 draws thread 230 from thread feeding devices 200, causing thread 230 to move in a "downstream" direction 240 from spools 210 towards knitting devices 140.

Figure 2:
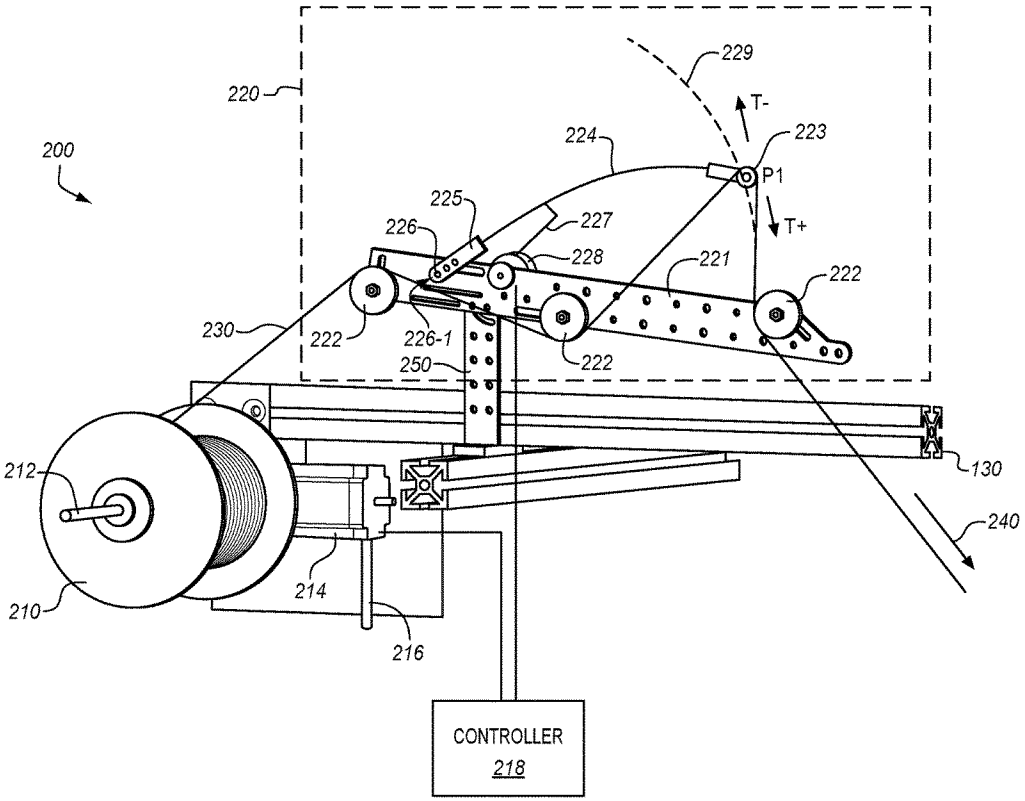
FIG. 2 is a diagram illustrating a thread feeding device for a knitting machine in an exemplary embodiment

FIG. 2 is a diagram illustrating a thread feeding device 200 for knitting machine 100 in an exemplary embodiment. As shown in this embodiment, thread feeding device 200 includes spool 210, which holds thread 230 in place for distribution to a knitting device 140 (of FIG. 1). As used herein, spool 210 is a rotating cylinder around which thread 230 is wound, and is for example independent of/distinct from thread 230 which is wound around spool 210. Spool 210 rotates about axis 212, and is driven by motor 214 (e.g., a variable-speed motor) to supply thread 230 via thread path 220. Motor 214 is powered via power connection 216, and the speed of motor 214 is controlled by controller 218. Controller 218 may be implemented, for example, as custom circuitry, as a processor executing programmed instructions, or some combination thereof.

Thread feeding device 200 further comprises thread path 220. As illustrated in FIG. 2, thread path 220 is supported by member 250, which attaches frame 221 of thread feeding device 220 to support 130 of knitting machine 100. Rollers 222 are attached to frame 221, and in combination define path 220 for thread 230 to travel from spool 210 to knitting device 240. One of the elements along path 220 is mobile guide 223 (e.g., a mobile roller), which is attached to curved arm 224. Arm 224 is attached to bar 225, and may pivot about point 226 in order to enable guide 223 to travel along arc 229. In this manner, when tension is increased by a knitting device 140 drawing thread faster, mobile guide 223 moves along arc 229 away from a default position (e.g., P1) in direction T+, and when tension is decreased by knitting machine 100 drawing thread more slowly, mobile guide 223 moves along arc 229 in direction T−. Biasing spring 226-1 may be utilized to return mobile guide 223 to the default position in the absence of substantial levels of tension.

Sensing element 227 is attached to arm 224, and therefore changes position as mobile guide 223 translates along arc 229. Sensor 228 (e.g., a potentiometer) measures the motion of sensing element 227, and determines an amount of translation of mobile guide 223 along arc 229. This information may then be provided to controller 218, which may determine an amount of tension applied to thread 230 by a knitting device 140 proximate to mobile guide 223, and controls a speed of motor 214 based on this information.

Illustrative details of the operation of thread feeding device 200 will be discussed with regard to FIG. 3. Assume, for this embodiment, that knitting machine 100 has initiated knitting processes, and a knitting device 140 is drawing thread 230 from thread feeding device 200. In this embodiment, knitting machine 100 is driven by a program stored in memory, which may or may not be accessible to thread feeding device 200. The program causes knitting device 140 to draw thread 230 from thread feeding device 200 at a variable and/or unpredictable rate, which may rapidly change the amount of tension applied to thread 230. As thread 230 may comprise a specialty thread (e.g., a thread that is capable of withstanding a very small amount of tension, such as less than a centiNewton of tension, before breaking), regulation of tension for thread 230 may be particularly important to ensure that breaks and/or tangles do not occur and delay fabrication of fabric 150.

Figure 3:
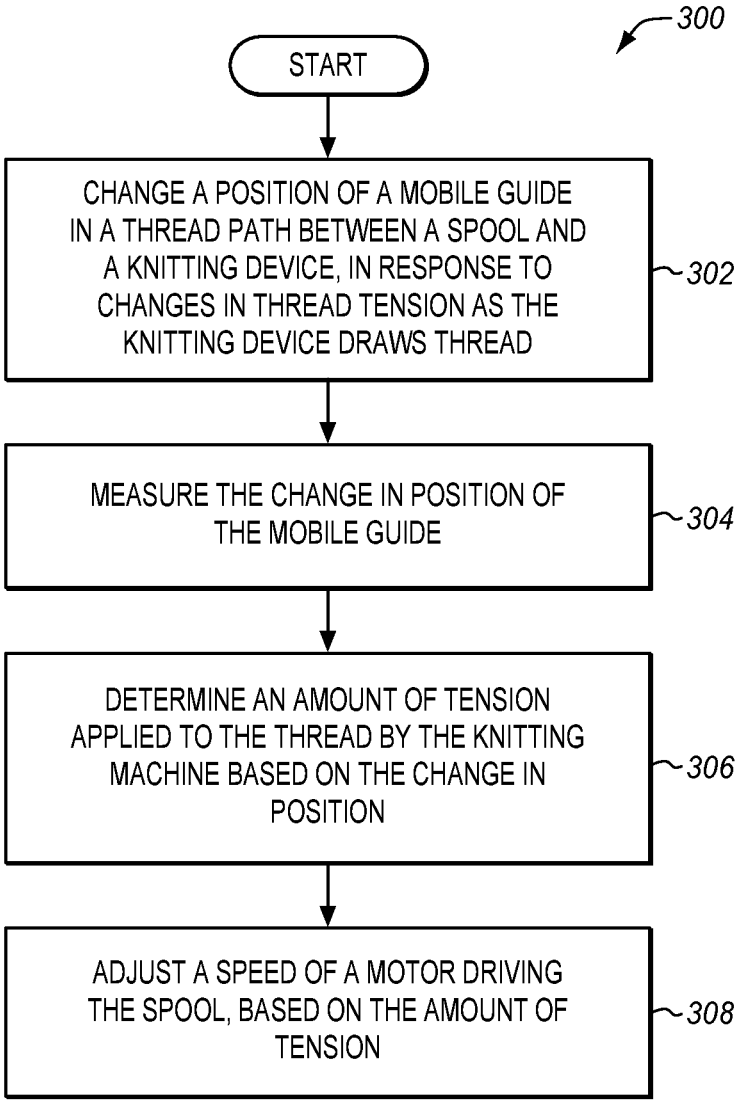
FIG. 3 is a flowchart illustrating a method for operating a thread feeding device in an exemplary embodiment.

FIG. 3 is a flowchart illustrating a method 300 for operating a thread feeding device 200 in an exemplary embodiment. The steps of method 300 are described with reference to thread feeding device 200 of FIG. 1, but those skilled in the art will appreciate that method 300 may be performed in other systems. The steps of the flowcharts described herein are not all inclusive and may include other steps not shown. The steps described herein may also be performed in an alternative order.

As knitting machine 100 draws thread 230 at a changing rate over time, knitting machine 100 generates varying levels of force at thread 230. Mobile guide 223, which is located in thread path 220 between spool 210 and knitting device 140, changes position (e.g., translates) in response to changes in thread tension as knitting device 140 draws thread 230 through mobile guide 223 (step 302). The change in position of mobile guide 223 causes arm 224 to rotate about point 226, and this displacement is detected by sensing element 227 of sensor 228. In this manner, sensor 228 measures the change in position of mobile guide 223 (e.g., from a default position P1) (step 304).

Controller 218, upon receiving input from sensor 228 indicating the change in position of mobile guide 223, proceeds to determine an amount of tension applied to thread 230 by knitting device 140 based on that change in position (step 306). For example, controller 218 may consult one or more predefined maps correlating data from sensor 228 to speeds for motor 214. A map may be defined to control motor speeds based on tension levels associated with each of multiple levels of sensor input. In this manner, by consulting a map, controller 218 determines the amount of tension applied by knitting device 140.

Controller 218 further proceeds to adjust a speed of motor 214, which is driving spool 210, based on the amount of tension (step 308). For example, controller 218 may adjust the speed of motor 214 based on data stored in a predefined map in memory, in order to reduce the amount of tension applied to thread 230, in effect changing the amount of tension based on the difference between the amount of tension and a desired tension value.

Utilizing method 300, the amount of tension applied to thread 230 may be beneficially controlled, even in environments where a knitting machine draws out thread 230 at varying and unpredictable rates. This ensures that thread 230 does not break or become tangled. Furthermore, since mobile guide 223 translates in response to increased drawing speed from knitting device 140, this has the effect of providing a buffer period that enables thread feeding device 200 to account for hysteresis (e.g., time delays) at motor 214 and other elements of thread feeding device 230.

Figure 4:
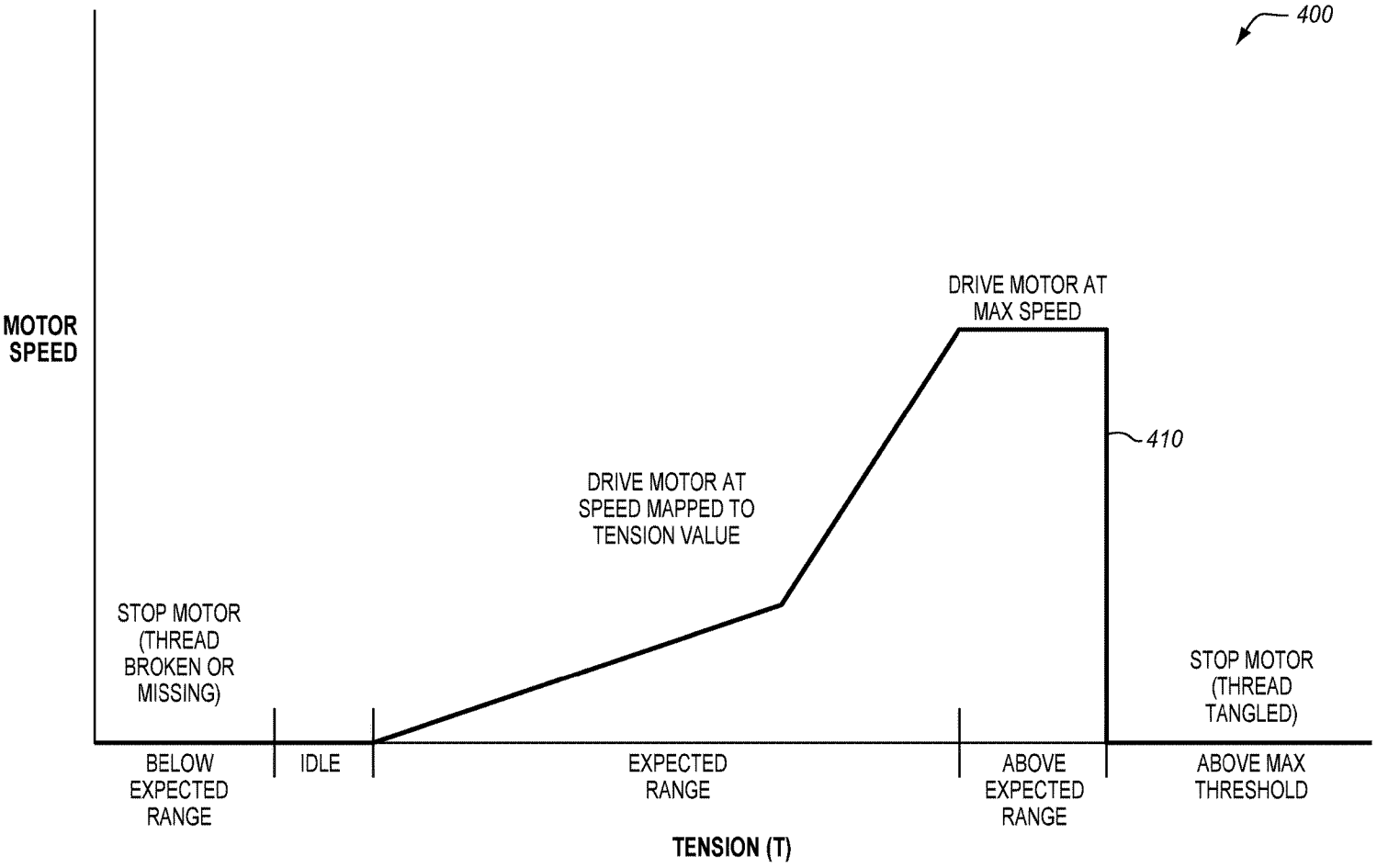
FIG. 4 is a chart illustrating relationships between motor speed and tension in an exemplary embodiment.

FIG. 4 is a chart 400 illustrating relationships between motor speed and tension in an exemplary embodiment. Specifically, chart 400 comprises a map that correlates detected tension levels (as indicated by data from sensor 228) with motor speeds. In this embodiment, chart 400 illustrates a piece-wise function 410, which varies depending on an amount of determined tension (T). Below an expected range of tension, controller 218 determines that thread 230 has broken or is missing. Hence, motor 214 is stopped. Meanwhile, within an expected range, the speed of motor 214 is governed by a series of mapped values that correlate T to motor speed. In this embodiment, the mapped values comprise a piecewise linear function, but in further embodiments the mapped values may be determined by experimentation, or may be indicated by a non-linear function. Above the expected range of values of T, controller 218 drives motor 214 at a maximum speed, in order to quickly reduce T. However, if T exceeds a maximum threshold value, motor 214 is stopped by controller 218, as T is indicative of thread 230 being tangled.

EXAMPLES

In the following examples, additional processes, systems, and methods are described in the context of a knitting machine that utilizes a dynamic thread feeding device.

Figure 5:
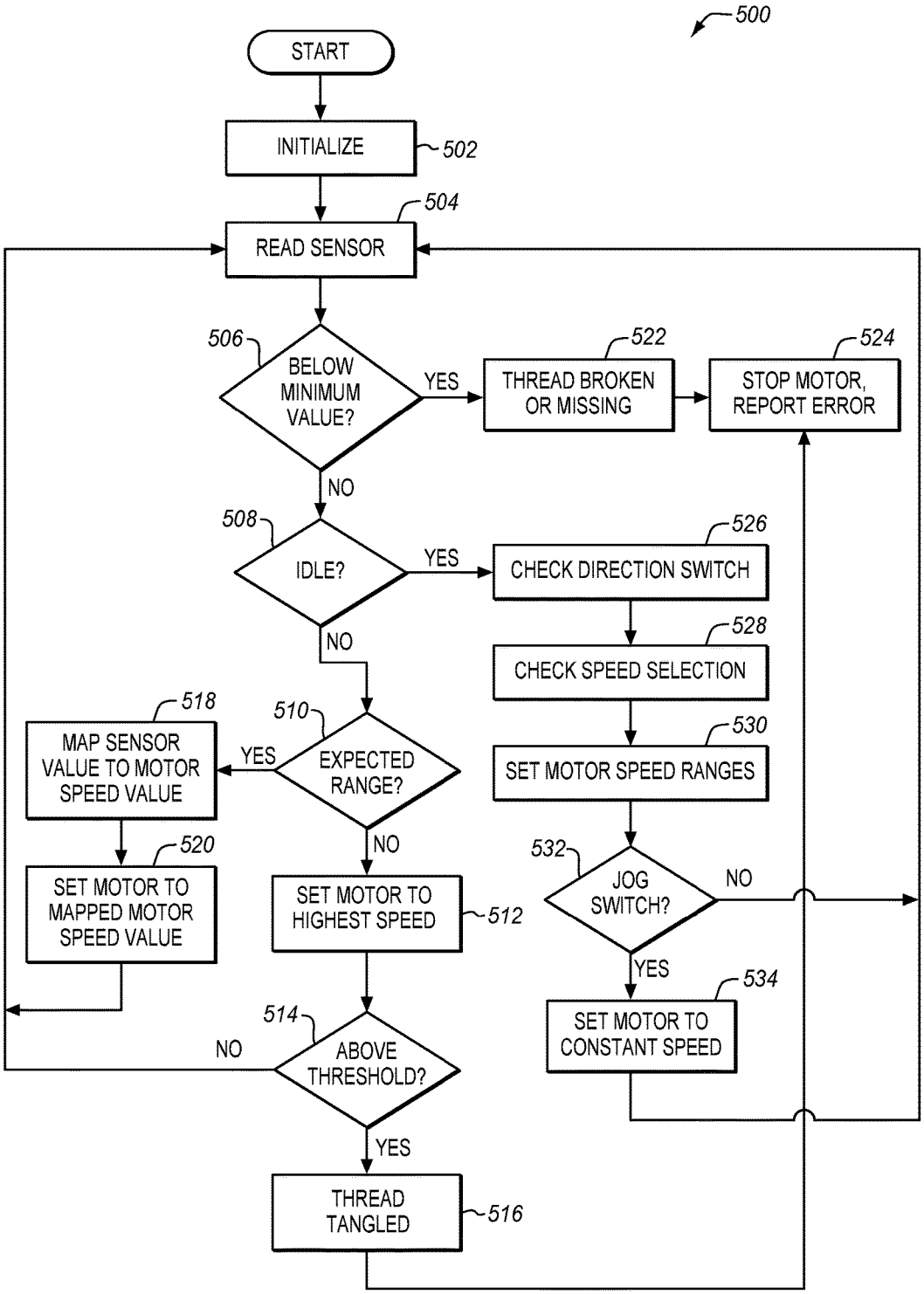
FIG. 5 is a flowchart illustrating a further method for operating a thread feeding device in an exemplary embodiment.

FIG. 5 is a flowchart illustrating a further method 500 for operating a thread feeding device 200 in an exemplary embodiment. According to FIG. 5, thread feeding device 200 initializes (step 502). This process may include loading a map (or set of maps) at controller 118 that correlates sensor input from sensor 228 with motor speeds for motor 214. In this manner, controller 218 may preemptively map sensor data indicating translation of mobile guide 223 to tension values that are used to regulate motor speed. Controller 218 may include multiple maps, each map being assigned to a different type of thread 230. In a further embodiment, each map may be assigned to a different combination of components that form arm 224, biasing spring 226-1, sensing element 227, and bar 225.

Having initialized, controller 218 proceeds to read sensor 228 (step 504). Depending on the input provided from sensor 228, controller 218 determines whether the value is below a minimum value (e.g., a "resting" value when thread feeding device 200 is not feeding thread 230 to knitting machine 100) (step 506). If the value is below the expected range (e.g., as indicated in the loaded map), then controller 218 determines that thread 230 is missing or broken (step 522), and reports an error condition (step 524).

Alternatively, an idle switch has been set at knitting machine 100, then an idle condition may be detected (step 508). Thus, controller 218 engages in additional processing by reviewing a direction switch set by an operator (indicating the direction in which knitting is occurring at knitting machine 100) (step 526), checking a speed selection indicated by the operator (step 528), and setting motor speed ranges for motor 214 (step 530). If controller 218 detects that a jog switch is set (step 532), then controller 218 sets motor 214 to a constant speed (step 534). This jog operation may help an operator to initially set up thread feeding device 200 before knitting machine 100 engages in operation where active knitting takes place.

If an idle condition is not detected in step 508, controller 218 determines whether or not sensor input indicates a tension value within an expected range (step 510). If the tension value is within the expected range, then controller 218 maps the sensor value to a motor speed value (as indicated by a map) (step 518), and proceeds to adjust the speed of motor 214 to the mapped value (step 520). Alternatively, if the tension value is above the expected range, controller 218 sets motor 214 to the highest speed available in order to rapidly reduce tension and avoid a break (step 512). However, if the tension is above a maximum threshold value (step 514), then controller 218 detects a tangled thread (step 516), and proceeds to stop motor 214 and report an error condition (step 524). The error condition may be reported, for example, via a display (not shown).

Figure 6:
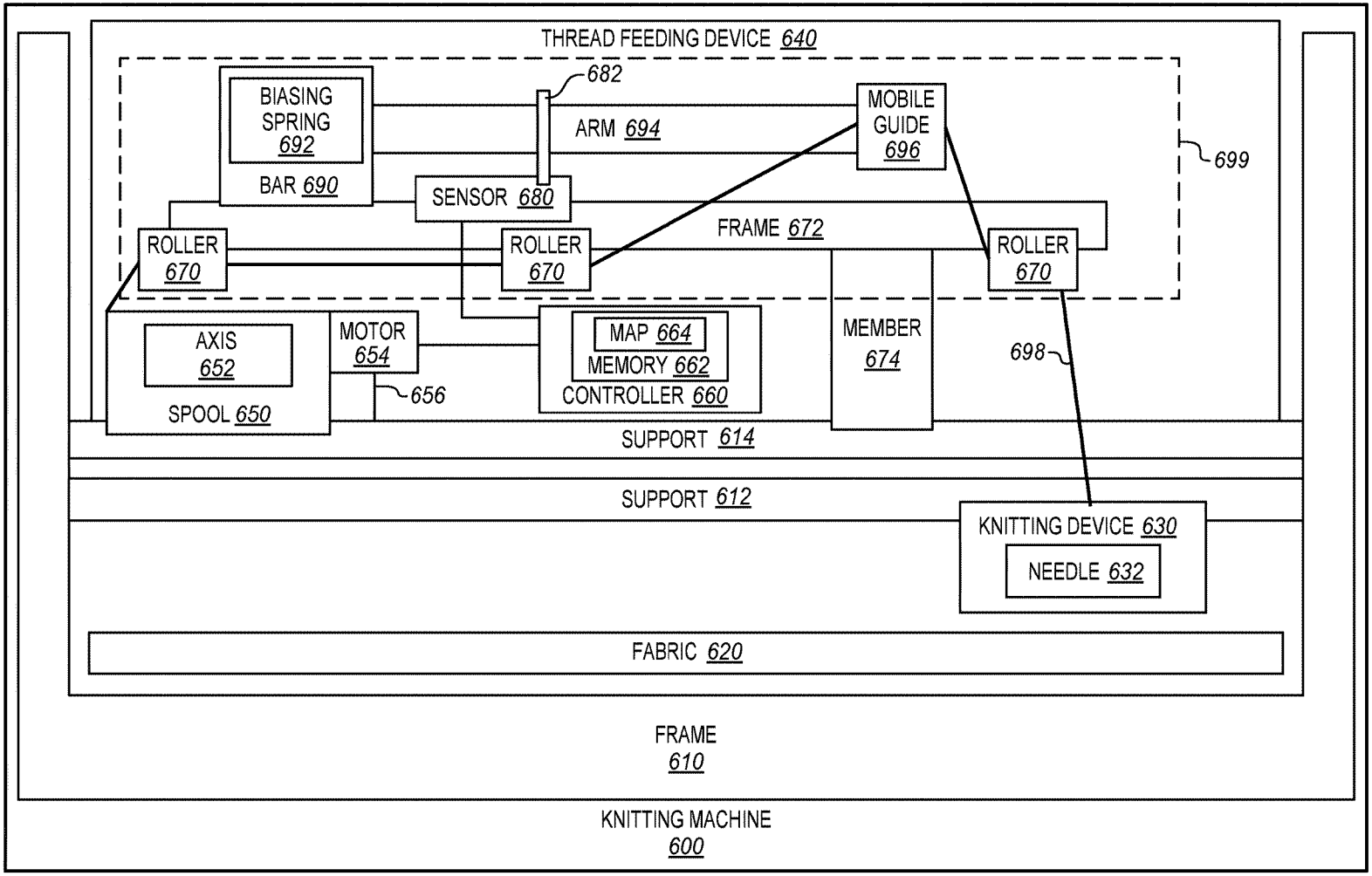
FIG. 6 is a block diagram of a system in an exemplary embodiment.

FIG. 6 is a block diagram of a knitting machine 600 in an exemplary embodiment. As shown in FIG. 6, knitting machine 600 includes frame 610, to which supports 612 and 614 are attached. Knitting machine 600 further includes knitting device 630 which is attached to support 612, and utilizes needle 632 to weave and/or stitch fabric 620 as desired. Thread feeding device 640 provides thread 698 to knitting device 630. Thread feeding device 630 includes spool 650, which rotates about axis 652, and is driven by motor 654 as motor 654 is provided power by power connection 656. The operation of motor 654 is controlled by controller 660, which utilizes map 664 in memory 662 to correlate sensor data with motor speeds (i.e., correlating mobile guide position to thread tension, based on input from sensor 680).

Thread feeding device 640 further includes member 674, which is attached to support 614, and frame 672. Rollers 670 are attached to frame 672, and define a thread path 699 for thread 698 to follow as it travels from spool 650 to knitting device 630. Sensor 680 includes a sensing element 682 for sensing deflection/translation of mobile guide 696, by measuring a position of arm 694. Bar 690 is attached to arm 694, and is held to a default position in low-tension operations by biasing spring 692.

Figure 7:
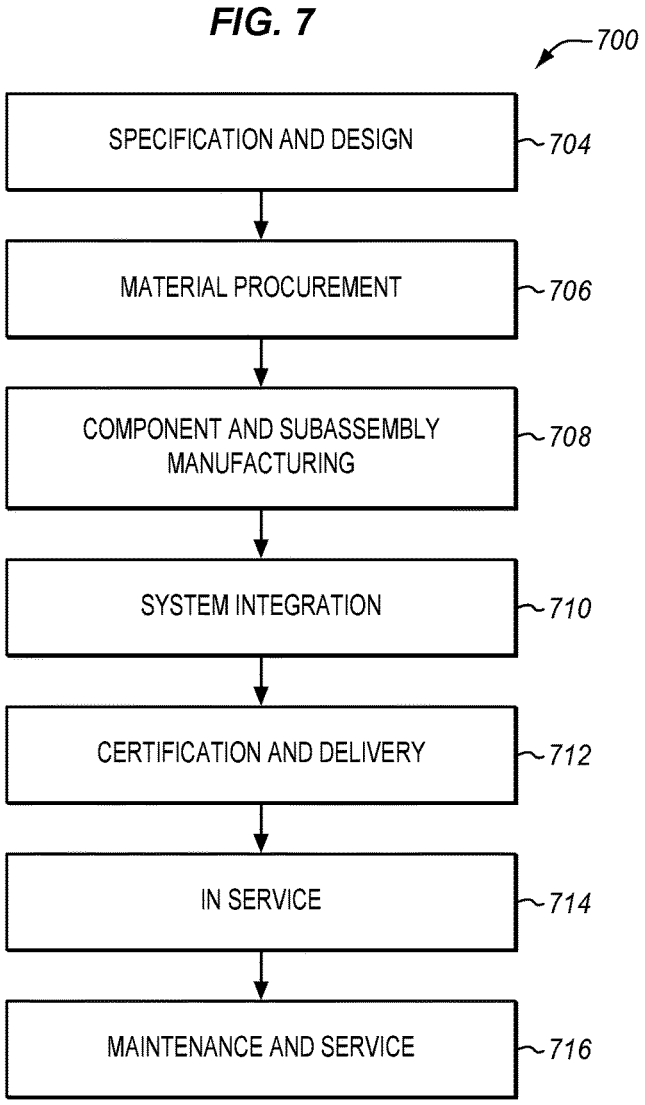
FIG. 7 is a flow diagram of aircraft production and service methodology in an exemplary embodiment.
Figure 8:
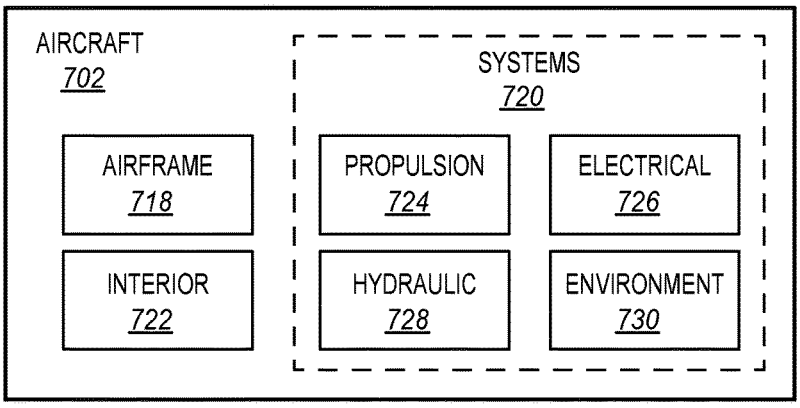
FIG. 8 is a block diagram of an aircraft in an exemplary embodiment.

Referring more particularly to the drawings, embodiments of the disclosure may be described in the context of an aircraft manufacturing and service method 700 as shown in FIG. 7 and an aircraft 702 as shown in FIG. 8. During pre-production, exemplary method 700 may include specification and design 704 of the aircraft 702 and material procurement 706. During production, component and subassembly manufacturing 708 and system integration 710 of the aircraft 702 takes place. Thereafter, the aircraft 702 may go through certification and delivery 712 in order to be placed in service 714. While in service by a customer, the aircraft 702 is scheduled for routine maintenance and service 716 (which may also include modification, reconfiguration, refurbishment, and so on).

Each of the processes of method 700 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 8, the aircraft 702 produced by exemplary method 700 may include an airframe 718 with a plurality of systems 720 and an interior 722. Examples of high-level systems 720 include one or more of a propulsion system 724, an electrical system 726, a hydraulic system 728, and an environmental system 730. Any number of other systems may be included. Although an aerospace example is shown, the principles of the invention may be applied to other industries, such as the automotive industry.

Apparatus and methods embodied herein may be employed during any one or more of the stages of the production and service method 700. For example, components or subassemblies corresponding to production stage 708 may be fabricated or manufactured in a manner similar to components or subassemblies produced while the aircraft 702 is in service. Also, one or more apparatus embodiments, method embodiments, or a combination thereof may be utilized during the production stages 708 and 710, for example, by substantially expediting assembly of or reducing the cost of an aircraft 702. Similarly, one or more of apparatus embodiments, method embodiments, or a combination thereof may be utilized while the aircraft 702 is in service, for example and without limitation, to maintenance and service 716. For example, the techniques and systems described herein may be used for steps 706, 708, 710, 714, and/or 716, and/or may be used for airframe 718 and/or interior 722. These techniques and systems may even be utilized for systems 720, including for example propulsion 724, electrical 726, hydraulic 728, and/or environmental 730.

In one embodiment, knitting machine 100 generates knitted fabrics for use with interior 722, and fabricates these fabrics during component and subassembly manufacturing 708. The fabrics may then be assembled into an aircraft in system integration 710, and then be utilized in service 714 until wear renders the fabrics unusable. Then, in maintenance and service 716, fabrics may be discarded and replaced with a newly manufactured fabric. Thread feeding device 200 may be utilized by knitting machine 100 while fabricating new fabrics, to enhance the overall manufacturing speed of those fabrics.

Any of the various control elements (e.g., electrical or electronic components) shown in the figures or described herein may be implemented as hardware, a processor implementing software, a processor implementing firmware, or some combination of these. For example, an element may be implemented as dedicated hardware. Dedicated hardware elements may be referred to as "processors", "controllers", or some similar terminology. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, a network processor, application specific integrated circuit (ASIC) or other circuitry, field programmable gate array (FPGA), read only memory (ROM) for storing software, random access memory (RAM), non-volatile storage, logic, or some other physical hardware component or module.

Also, an element may be implemented as instructions executable by a processor or a computer to perform the functions of the element. Some examples of instructions are software, program code, and firmware. The instructions are operational when executed by the processor to direct the processor to perform the functions of the element. The instructions may be stored on storage devices that are readable by the processor. Some examples of the storage devices are digital or solid-state memories, magnetic storage media such as a magnetic disks and magnetic tapes, hard drives, or optically readable digital data storage media.

Although specific embodiments are described herein, the scope of the disclosure is not limited to those specific embodiments. The scope of the disclosure is defined by the following claims and any equivalents thereof.

The invention claimed is:

1. A thread feeding device comprising:

a mobile guide in a thread path that changes position along an arc due to changes in thread tension as a knitting device draws thread through the mobile guide, the mobile guide being mounted to a curved arm rotatably attached to a frame of the thread feeding device; and a sensor that measures an arcing change in position of the mobile guide as thread tension changes.

2. The thread feeding device of claim 1 further comprising:

a spool that supplies thread to the knitting device through the thread path; and a motor that drives the spool.

3. The thread feeding device of claim 2 further comprising:

a controller that correlates mobile guide position to thread tension based on input from the sensor, and adjusts a speed of the motor based on the amount of tension.

4. The thread feeding device of claim 3, wherein:

the controller compares the thread tension to a desired tension value, and adjusts the speed of the motor based on a difference between the thread tension and the desired tension value.

5. The thread feeding device of claim 3 wherein:

the controller increases a speed of the motor in response to determining that the amount of tension exceeds a threshold value.

6. The thread feeding device of claim 3 wherein:

the controller decreases a speed of the motor in response to determining that the amount of tension is less than a threshold value.

7. The thread feeding device of claim 3 wherein:

the controller stops the motor in response to determining that the amount of tension is indicative of a tangle at the knitting device.

8. The thread feeding device of claim 1 wherein:

the thread path includes a roller that is upstream of the mobile guide with respect to a direction of travel of the thread, and further includes a roller that is downstream of the mobile guide with respect to the direction of travel of the thread.

9. The thread feeding device of claim 1 wherein:

the sensor comprises a potentiometer.

10. The thread feeding device of claim 1 further comprising:

a biasing spring that drives the curved arm to a default angle of rotation, wherein the mobile guide is fixed to a distal portion of the curved arm, and the mobile guide comprise a mobile roller.

11. A method comprising:

measuring thread tension as the thread is fed into a knitting device by measuring displacement of a mobile guide which changes position along an arc as thread tension changes, the mobile guide being mounted to a curved arm rotatably attached to a frame of the thread feeding device; and controlling a speed at which the thread is fed into the knitting device based upon the measured thread tension.

12. The method of claim 11, wherein:

measuring the thread tension comprises:

changing a position of a mobile guide in a thread path between a spool and a knitting device, in response to changes in thread tension as the knitting device draws thread through the mobile guide;

measuring the change in position of the mobile guide; and determining an amount of tension applied to the thread by the knitting machine based on the change in position; and controlling the speed comprises adjusting a speed of a motor driving the spool, based on the amount of tension.

13. The method of claim 12 further comprising:

increasing a speed of the motor in response to determining that the amount of tension exceeds a threshold value.

14. The method of claim 12 further comprising:

decreasing a speed of the motor in response to determining that the amount of tension is less than a threshold value.

15. The method of claim 12 further comprising:

transmitting an error signal to a user in response to determining that the amount of tension is indicative of a break in the thread.

16. The method of claim 12 further comprising:

receiving input indicating a direction in which thread is drawn from the spool by the knitting device; and adjusting a direction that the motor drives the spool, based on the input.

17. The method of claim 12 further comprising:

stopping the motor in response to determining that the amount of tension is indicative of a tangle at the knitting device.

18. The method of claim 12 wherein:

detecting the change in position comprises receiving input from a potentiometer that measures an angle of the curved arm.

19. A non-transitory computer readable medium embodying programmed instructions which, when executed by a processor, are operable for performing a method comprising:

measuring thread tension as the thread is fed into a knitting device by measuring displacement of a mobile guide which changes position along an arc as thread tension changes, the mobile guide being mounted to a curved arm rotatably attached to a frame of the thread feeding device; and controlling a speed at which the thread is fed into the knitting device based upon the measured thread tension.

20. The medium of claim 19, wherein:

measuring the thread tension comprises:

changing a position of a mobile guide in a thread path between a spool and a knitting device, in response to changes in thread tension as the knitting device draws thread through the mobile guide;

measuring the change in position of the mobile guide; and determining an amount of tension applied to the thread by the knitting machine based on the change in position; and controlling the speed comprises adjusting a speed of a motor driving the spool, based on the amount of tension.

21. The medium of claim 20 wherein the method further comprises:

increasing a speed of the motor in response to determining that the amount of tension exceeds a threshold value.

22. The medium of claim 20 wherein the method further comprises:

decreasing a speed of the motor in response to determining that the amount of tension is less than a threshold value.

23. The medium of claim 20 wherein the method further comprises:

transmitting an error signal to a user in response to determining that the amount of tension is indicative of a break in the thread.

24. The medium of claim 20 wherein the method further comprises:

receiving input indicating a direction in which thread is drawn from the spool by the knitting machine; and adjusting a direction that the motor drives the spool, based on the input.

25. The medium of claim 20 wherein:

detecting the change in position comprises receiving input from a potentiometer that measures an angle of the curved arm.

26. A system comprising:

a spool that supplies thread to a knitting device through a thread path;

a motor that drives the spool;

a mobile guide in the thread path that changes position along an arc due to changes in thread tension as the knitting device draws thread through the mobile guide, the mobile guide being mounted to a curved arm rotatably attached to a frame of the thread feeding device;

a sensor that measures an arcing change in position of the mobile guide; and a controller that correlates mobile guide position to thread tension, and adjusts a speed of the motor based on the amount of tension.

* * * * *